US006000987A

United States Patent [19]

Belin et al.

[11] Patent Number: 6,000,987

[45] Date of Patent: Dec. 14, 1999

[54] DOLL OR THE LIKE WITH REPLACEABLE VOICE-ACTIVATED SPEAKING AND RECORDING MECHANISM

[76] Inventors: Barbara Ross Belin, 575 Park Ave., New York, N.Y. 10021; David W. Beeline, 1705 Plaza Cir., Des Moines, Iowa 50322

[21] Appl. No.: 08/419,174

[22] Filed: Apr. 10, 1995

[51] Int. Cl.[6] ..... A63H 30/00; A63H 3/28

[52] U.S. Cl. ..... 446/175; 446/302

[58] Field of Search ..... 446/302, 303, 446/299, 297, 484, 175

[56] References Cited

U.S. PATENT DOCUMENTS

| | | | |
|---|---|---|---|
| 3,080,679 | 3/1963 | Hardigan | 446/302 |
| 3,159,942 | 12/1964 | Fiske | 446/302 |
| 3,165,320 | 1/1965 | Ryan . | |
| 3,239,229 | 3/1966 | Freeman et al. . | |
| 3,685,200 | 8/1972 | Noll . | |
| 3,755,960 | 9/1973 | Tepper et al. . | |
| 4,318,245 | 3/1982 | Stowell et al. | 446/303 X |
| 4,516,950 | 5/1985 | Berman et al. . | |
| 4,521,205 | 6/1985 | Spector . | |
| 4,710,145 | 12/1987 | Hall Vandis | 446/302 X |
| 4,775,352 | 10/1988 | Curran et al. . | |
| 4,878,871 | 11/1989 | Noto . | |
| 4,913,676 | 4/1990 | Koguchi | 446/175 X |
| 5,059,149 | 10/1991 | Stone | 446/302 X |
| 5,279,514 | 1/1994 | Lacombe et al. | 446/175 X |

OTHER PUBLICATIONS

Ameri–Bear, Playthings, Nov. 1986, p. 14, 446–303.

*Primary Examiner*—D Neal Muir
*Attorney, Agent, or Firm*—Zarley, McKee, Thomte, Voorhees & Seas

[57] ABSTRACT

A doll or animal has either an interior compartment or a back pack which contains an audio device having a recorder to record sounds and a sound player to play the sounds recorded. A tape player is also provided to permit a plurality of separate recorded tapes or the like for playing prerecorded messages, stories, or songs. A source of power such as a battery is used to provide power to the various components. A control switch is used to provide a master control over all of the components.

2 Claims, 2 Drawing Sheets

DOLL OR THE LIKE WITH REPLACEABLE VOICE-ACTIVATED SPEAKING AND RECORDING MECHANISM

BACKGROUND OF THE INVENTION

It is common to provide a doll or the like with some sort of a speaking mechanism that can be mechanically actuated to express a short sound or comment.

However, the existing devices do not have the capability to pick up and record a child's voice who is playing with the doll. Further, it is not possible to implement selectively in the doll a prerecorded message for the child to enjoy. Voice activated recording devices have found no useful application in this art.

It is therefore a principal object of the invention to provide a doll or the like with a replaceable voice actuated speaking and recording mechanism, incorporated either within the doll or on a suitable backpack thereon.

A further object of this invention is to provide a doll or the like wherein a plurality of recorded messages, stories, songs or the like can be easily selectively inserted into and removed from the doll.

A still further object of the invention is to provide a doll or the like with replaceable voice-activated speaking and recording mechanism which can be easily operated.

These and other objects will be apparent to those skilled in the art.

SUMMARY OF THE INVENTION

A doll or animal has either an interior compartment or a back pack which contains an audio device having a recorder to record sounds and a sound player to play the sounds recorded. A tape player is also provided to permit a plurality of separate recorded tapes or the like for playing prerecorded messages, stories, or songs. A source of power such as a battery is used to provide power to the various components. A control switch is used to provide a master control over all of the components.

DESCRIPTION OF THE PREFERRED EMBODIMENT

Figure 2:
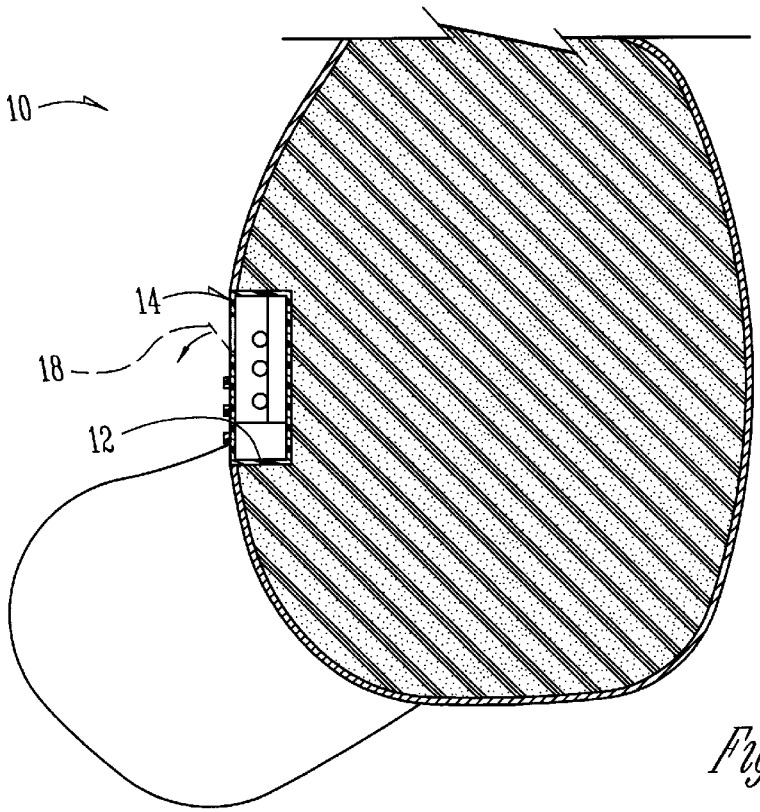
FIG. 2 is a sectional view of FIG. 1 taken on line 2—2 of FIG. 1.

The number 10 designates a conventional stuffed doll or animal. The term doll as used herein will also be understood to include stuffed animals or the like. An interior space 12 (FIG. 2) is provided in the front or back of doll 10 and receives control box 14 in which the audio components are provided.

Box 14 includes a conventional tape deck 16 capable of detachably receiving one of a plurality of audio tapes 16A for either playing or recording. A suitable closure 18 for the tape deck is shown by the dotted line in FIG. 2.

Figure 1:
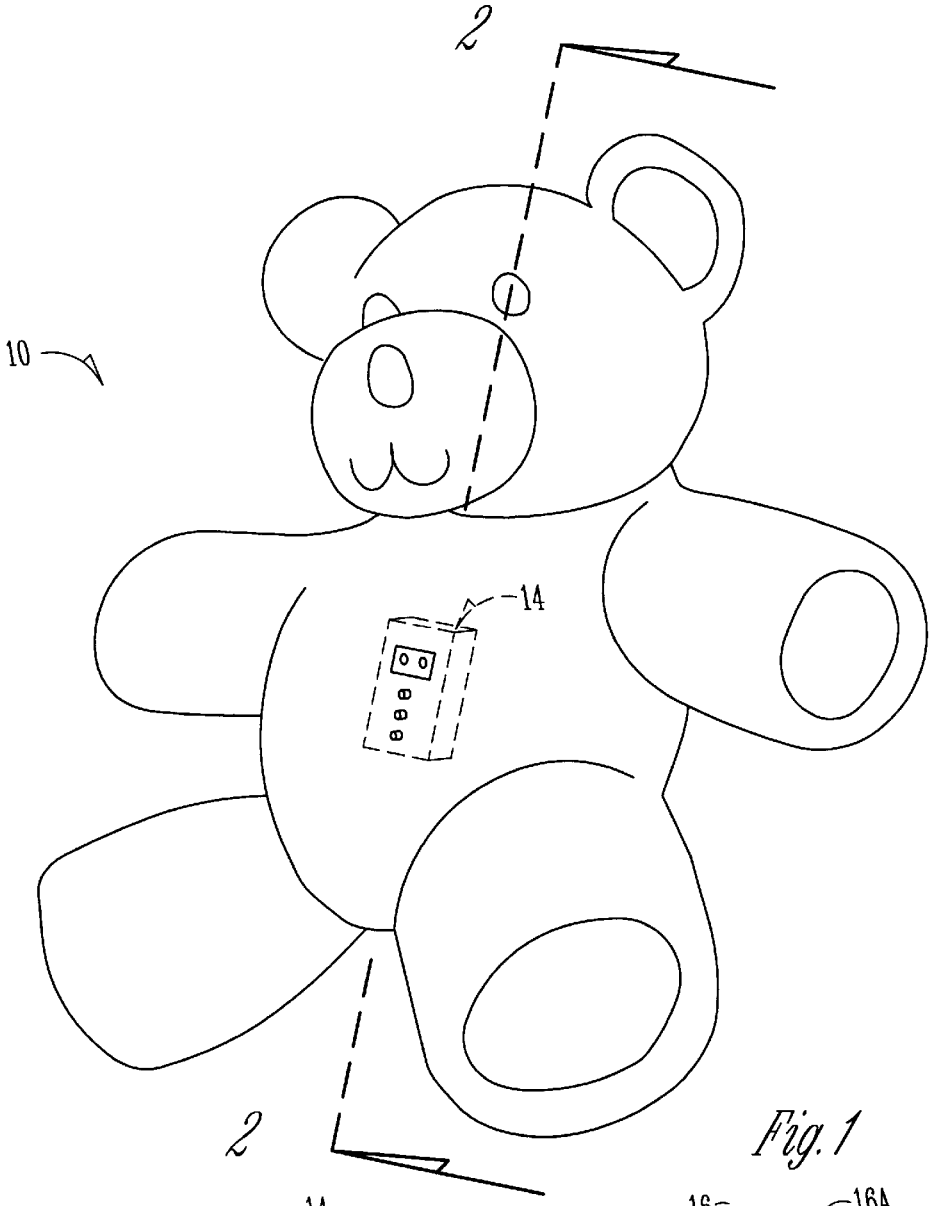
FIG. 1 is a perspective view of a doll of the invention.
Figure 4:
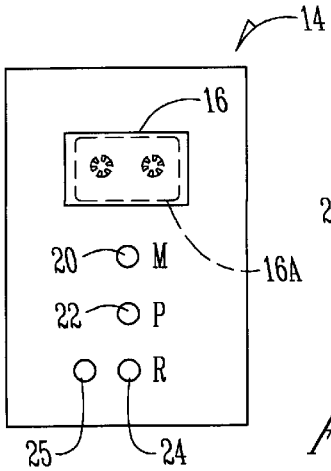
FIG. 4 is a large scale front elevational view of the audio package used in either of the devices of FIGS. 1 or 3.

Conventional pressure actuated on/off switches 20, 22, 24 and 25 are mounted in the front of box 14 (FIGS. 1 and 4).

Figure 5:
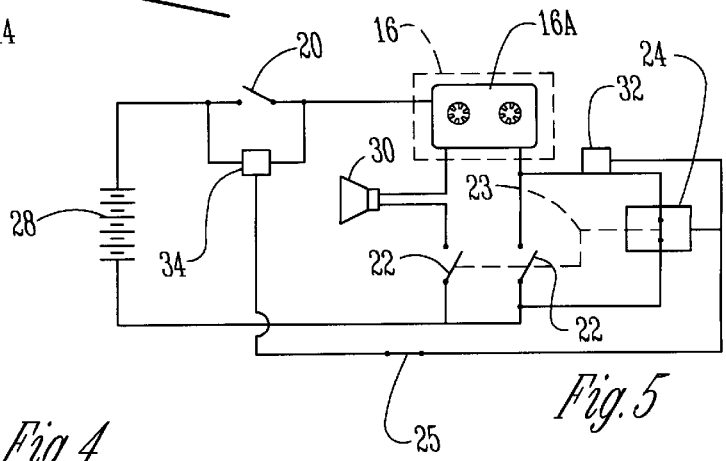
FIG. 5 is a schematic wiring diagram of the audio system.

The control circuit 26 (FIG. 5) including battery 28 (normally be a conventional D size battery), is directly connected to control switch 20 which in turn is directly connected to tape deck 16 to provide power for either recording or playing. A sound emitting speaker 30 is directly connected to the tape deck 16 and will broadcast the contents of the tape 16A whenever double pole "play" switch 22 and master switch 24 are closed. Switch 22 should be ganged or operatively connected to record switch 24 by link 23 so that when one switch is closed, the other switch is open.

Control LEDs (not shown) can be used in conjunction with switches 20, 22, 24 and 25 so that each switch will be lighted when it is closed.

When it is desired to go to the record mode, switch 24 is closed, and the receiver 32 will cause the voice of the child to be recorded on tape 16A.

An internal voice actuation switch 34 capable of bypassing switches 20 and closing switch 24 when the switch 20 is open, when responder 32 picks up the voice of the child, is operative when automatic switch 25 is closed.

DESCRIPTION OF THE ALTERNATE FORM OF THE INVENTION

Figure 3:
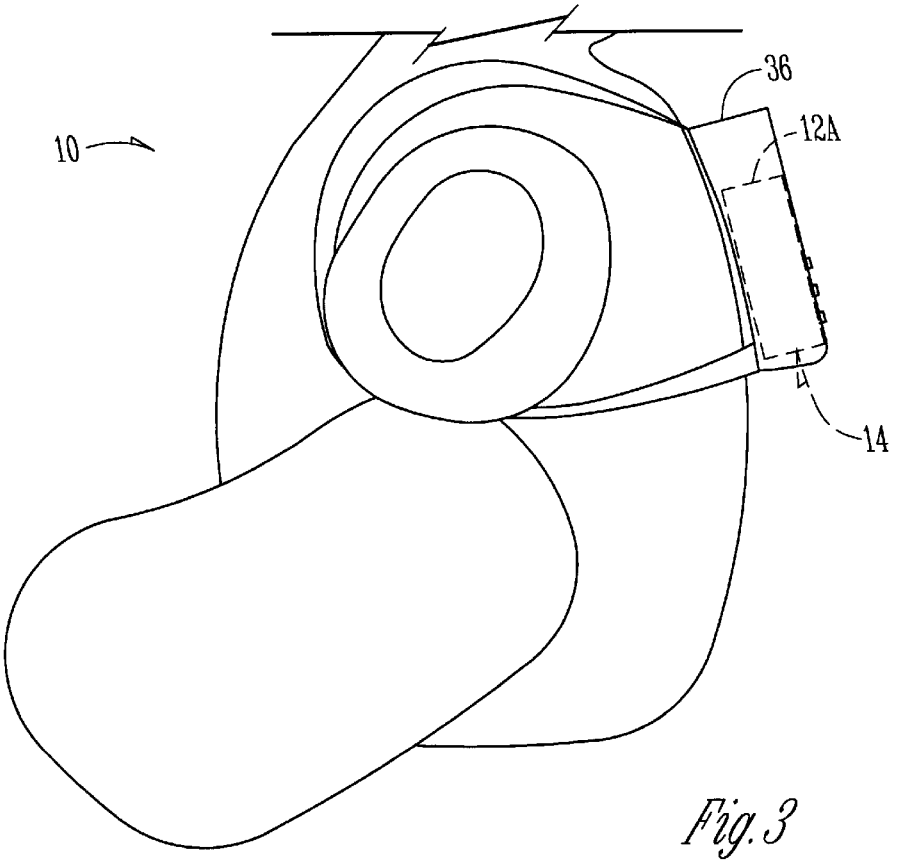
FIG. 3 is a partial side elevational view of the doll of FIG. 1 but showing an alternate form of the invention.

FIG. 3 shows a backpack 36 on the doll 10 with an interior space 12A to receive box 14. Except for the location of box 14, both forms of the invention (FIGS. 1 and 3) operate similarly.

DESCRIPTION OF THE OPERATION

When it is desired to have a message, story or song played for the child, the switches 20 and 22 are closed. Since the switch 25 is normally open, and since switch 24 is always open when switch 22 is closed, tape deck 16 will be in the play mode and the contents of tape 16A will be broadcast as described above.

If it is desired to record what the child may be saying while playing with the doll, the switches 20 and 22 are closed, whereupon switches 24 and 25 remain open. That arrangement places the tape deck in a record mode, and any audible reactions of the child are recorded on tape 16A.

When the doll is randomly placed with the child who may not be actively playing with the doll at the time, all switches except switch 25 will be opened and switch 25 will be closed. If and when the child starts to play with the doll, voice actuated switch 34 will close and will thus engage receiver 32 and close switch 24 with a suitable relay (not shown) so that tape deck 16 will be in a record mode even though switch 20 is open. The benefit of this arrangement is that the audio components will not drain battery 28 if some substantial time elapses before the child picks up the doll and begins to talk, laugh or sing in close proximity of the doll. Thus, the doll can be left in the child's room or crib all day, but will not be operational (recording) until the voice of the child actuates switch 34.

It is therefore seen that this invention will add substantial versatility to the doll art and will stimulate interaction between the child, the doll, and the adults who will place tapes in the doll, or retrieve recorded tapes bearing the recorded voice of the child.

What is claimed is:

1. The combination of a stuffed doll having an exterior covering and an interior space, and an audio device comprising, an audio device mounted within said interior space, said audio device comprising a first means to record sounds, a second means to play aloud those sounds recorded by said first means, said first means including means for receiving data for playing sounds aloud on said second means, said audio device including a source of power and a sound activated switch connecting said source of power and said first means, and said audio device having a master control switch having operative and inoperative positions to selectively control said first and second means, whereby sounds recorded by said first means will be played aloud only when said master control switch is manually moved to said operative position.

2. The combination of a stuffed doll having a backpack having an interior space, and an audio device comprising, an audio device mounted within said interior space, said audio device comprising a first means to record sounds, a second means to play aloud those sounds recorded by said first means, said first means including means for receiving data for playing sounds aloud on said second means, said audio device including a source of power and a sound activated switch connecting said source of power and said first means, and said audio device having a master control switch having operative and inoperative positions to selectively control said first and second means, whereby sounds recorded by said first means will be played aloud only when said master control switch is manually moved to said operative position.

* * * * *

UNITED STATES PATENT AND TRADEMARK OFFICE

CERTIFICATE OF CORRECTION

PATENT NO. : 6,000,987

DATED : December 14, 1999

INVENTOR(S) : Barbara Ross Belin and David W. Belin

It is certified that error appears in the above-identified patent and that said Letters Patent is hereby corrected as shown below:

On the title page:

Item: "[76]", line 3, the name "Beeline" should be corrected to "Belin".

Signed and Sealed this

Eighth Day of August, 2000

*Attest:*

*Attesting Officer*

Q. TODD DICKINSON

*Director of Patents and Trademarks*